US005687680A

United States Patent [19]

Shichinohe et al.

[11] Patent Number: 5,687,680

[45] Date of Patent: Nov. 18, 1997

[54] VALVE SYSTEM FOR OVERHEAD VALVE INTERNAL COMBUSTION ENGINE

[75] Inventors: Takashi Shichinohe; Yukio Ishiuchi, both of Saitama, Japan

[73] Assignee: Honda Giken Kogyo Kabushiki Kaisha, Tokyo, Japan

[21] Appl. No.: 501,798

[22] Filed: Jul. 13, 1995

[30] Foreign Application Priority Data

Jul. 13, 1994 [JP] Japan ..... 6-184100

[51] Int. Cl.[6] ..... F01L 1/14; F01L 13/08; F02F 11/00

[52] U.S. Cl. ..... 123/90.6

[58] Field of Search ..... 123/90.6, 90.31, 123/198 F, 195 R; 74/93

[56] References Cited

U.S. PATENT DOCUMENTS

| | | | |
|---|---|---|---|
| 3,142,996 | 8/1964 | Anderson | 123/195 R |
| 3,412,720 | 11/1968 | Binder | 123/195 R |
| 4,790,271 | 12/1988 | Onda | 123/182.1 |
| 4,898,040 | 2/1990 | Tamba et al. | 123/195 R |
| 5,558,059 | 9/1996 | Yoshinaga et al. | 123/198 E |

FOREIGN PATENT DOCUMENTS

| | | | |
|---|---|---|---|
| 61-72809 | 4/1986 | Japan | F01L 1/14 |

*Primary Examiner*—Andrew M. Dolinar
*Assistant Examiner*—Hieu T. Vo
*Attorney, Agent, or Firm*—Birch, Stewart, Kolasch & Birch, LLP

[57] ABSTRACT

An intake cam and an exhaust cam are formed integrally with a cam shaft, and a decompression cam is additionally provided adjacently to the front side of the exhaust cam. A rib is formed in back of the intake cam. A cylindrical surface portion having a diameter being the same as that of the outer periphery surface of a ball bearing for supporting the front portion of the cam shaft and being larger than the diameter of the base circle of the cam shaft, is formed on the front crank case, and a locking stepped portion is formed in back of the cylindrical surface portion. Cutout portions are formed in the locking stepped portion so that the cam shaft can be pulled forward in the state that the intake cam, exhaust cam and the decompression cam are arranged.

15 Claims, 14 Drawing Sheets

VALVE SYSTEM FOR OVERHEAD VALVE INTERNAL COMBUSTION ENGINE

BACKGROUND OF THE INVENTION

1. Field of the Invention

The present invention relates to a valve system in an overhead internal combustion engine having tappets and push rods, and particularly to a valve system in an internal combustion engine of a type in which a cylinder block is removably connected to a crank case wherein a cam shaft cannot be removed unless the tappets are taken out.

2. Description of Background Art

In a prior art overhead-valve internal combustion engine in which a cam shaft parallel to a crank case is disposed near the crank case and tappets and push rods are interposed between rocker arms and the cam shaft, as disclosed in Japanese Patent Laid-open No. SHO 61-72809, the tappets and push rods are so constructed as to be separable. Accordingly, in the case where a cylinder block and a crank case are separably connected to each other and the cam shaft is axially removably fitted in the crank case, when the cam shaft is pulled out for inspection or checking thereof, the tappets are dropped in the crank case and they cannot be taken out unless the crank case is disassembled. A large amount of repair work is required in the case where a main shaft and a countershaft are pivotally supported by the crank case.

SUMMARY AND OBJECTS OF THE INVENTION

An object of the present invention is to provide a valve system in an overhead internal combustion engine, which is capable of solving the above-described problem. To achieve the above object, according to a preferred mode of the present invention, there is provided a valve system in an internal combustion engine in which a cam shaft is axially removably supported and push rods are reciprocated on the upper surface of the cam shaft through tappets for opening/closing overhead valves. An open portion for removing the cam shaft is formed such that the size thereof is larger than a cam base circle and smaller than a cam lobe vertex. Cutout portions larger than the cam lobe vertex are provided on part of the open portion. The cutout portions are disposed at positions facing the tappets relative to the axial center of the cam shaft. Ribs project from the cam base circle and are disposed on the cam shaft on the opposed side to the open portion while putting the cam lobes therebetween.

In the present invention having the above construction, when the cam lobe vertex of the cam shaft is aligned to the open portion for pulling out the cam shaft in the axial direction, the cam shaft cannot be pulled out unless the tappets are removed because the ribs are engaged with the tappets.

Since the cam shaft cannot be pulled out unless the tappets are removed, the tappets are prevented from being dropped in a crank chamber upon pulling out the cam shaft, thereby eliminating the necessity of a large amount of repair work such as the disassembly of the crank case.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Hereinafter, one embodiment of the present invention will be described with reference to FIGS. 1 to 14.

Figure 1:
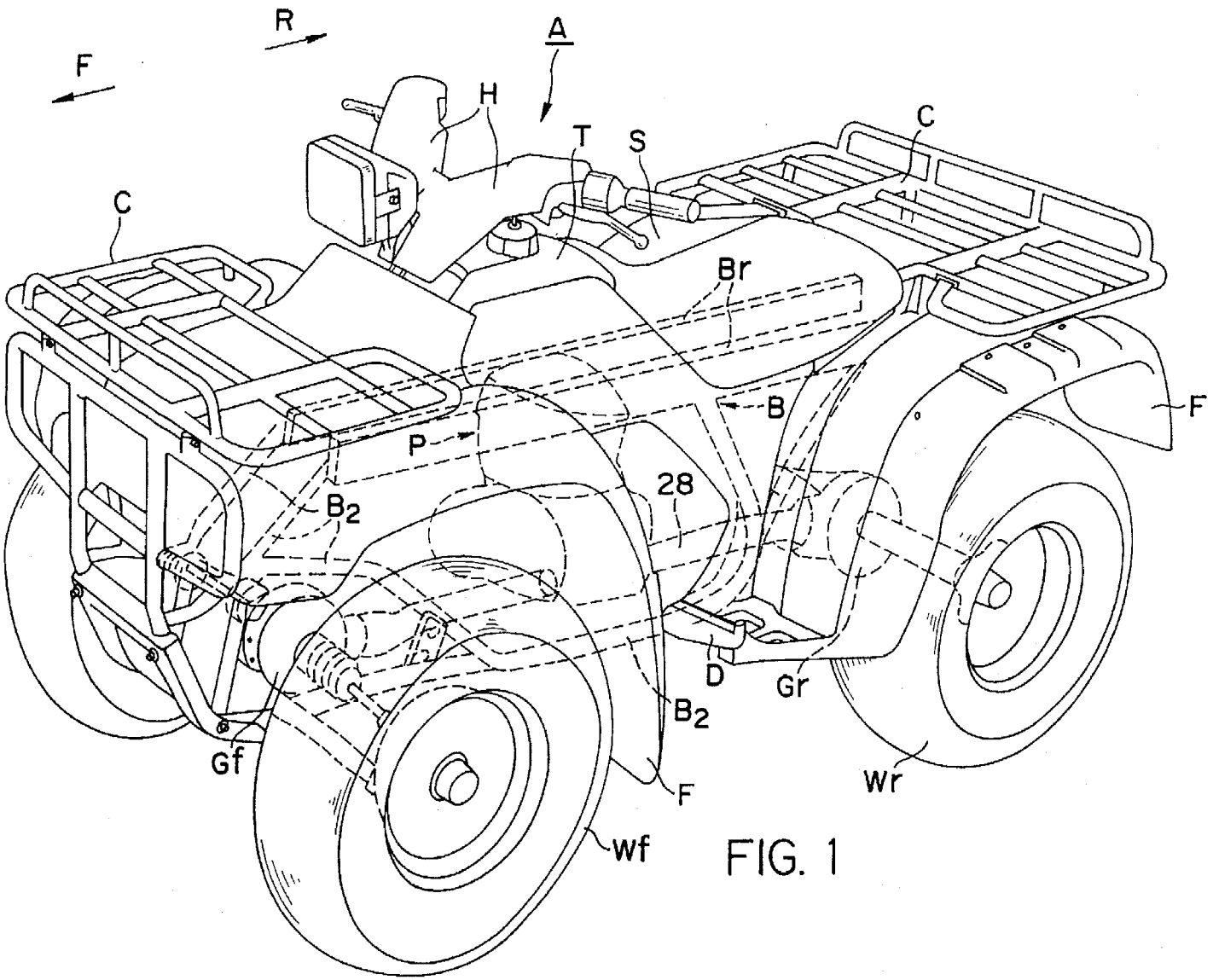
FIG. 1 is a schematic perspective view of an off-road running saddle type vehicle mounting a vehicular power unit provided with a valve system of an overhead valve internal combustion engine according to the present invention.

FIG. 1 shows an off-road running saddle type vehicle A called a buggy. In this vehicle A, a pair of right and left channel shaped main frames $B_1$ extend in the longitudinal direction on the upper side of a vehicular body, and pipe shaped frames $B_2$ are integrated with the lower portions of the channel shaped main frame $B_1$. Pairs of right and left front wheels Wf and rear wheels Wr, each mounting a balloon tire, are respectively provided on the front and rear portions of a vehicular frame B composed of the channel shaped main frames $B_1$ and the pipe shaped frames $B_2$.

A steering handle H, a fuel tank T and a seat S are disposed from the front side to the rear side in this order on the upper side of the vehicle A. Under the fuel tank T and seat S, a power unit P for driving the front wheels Wf and the rear wheels Wr is mounted at the central portion of the vehicular frame B.

The vehicle A is also provided with fenders F for nearly covering the upper portions of the front wheels Wf and the rear wheels Wr, and with the carriers C positioned over the upper surfaces of the fenders F.

Steps D for supporting the two feet of an operator sitting astride the seat S are disposed on the lower side of the central portion of the vehicular frame B. A brake pedal (not shown)

is disposed near the right step D, and a change pedal (not shown) is disposed near the left step D.

Figure 2:
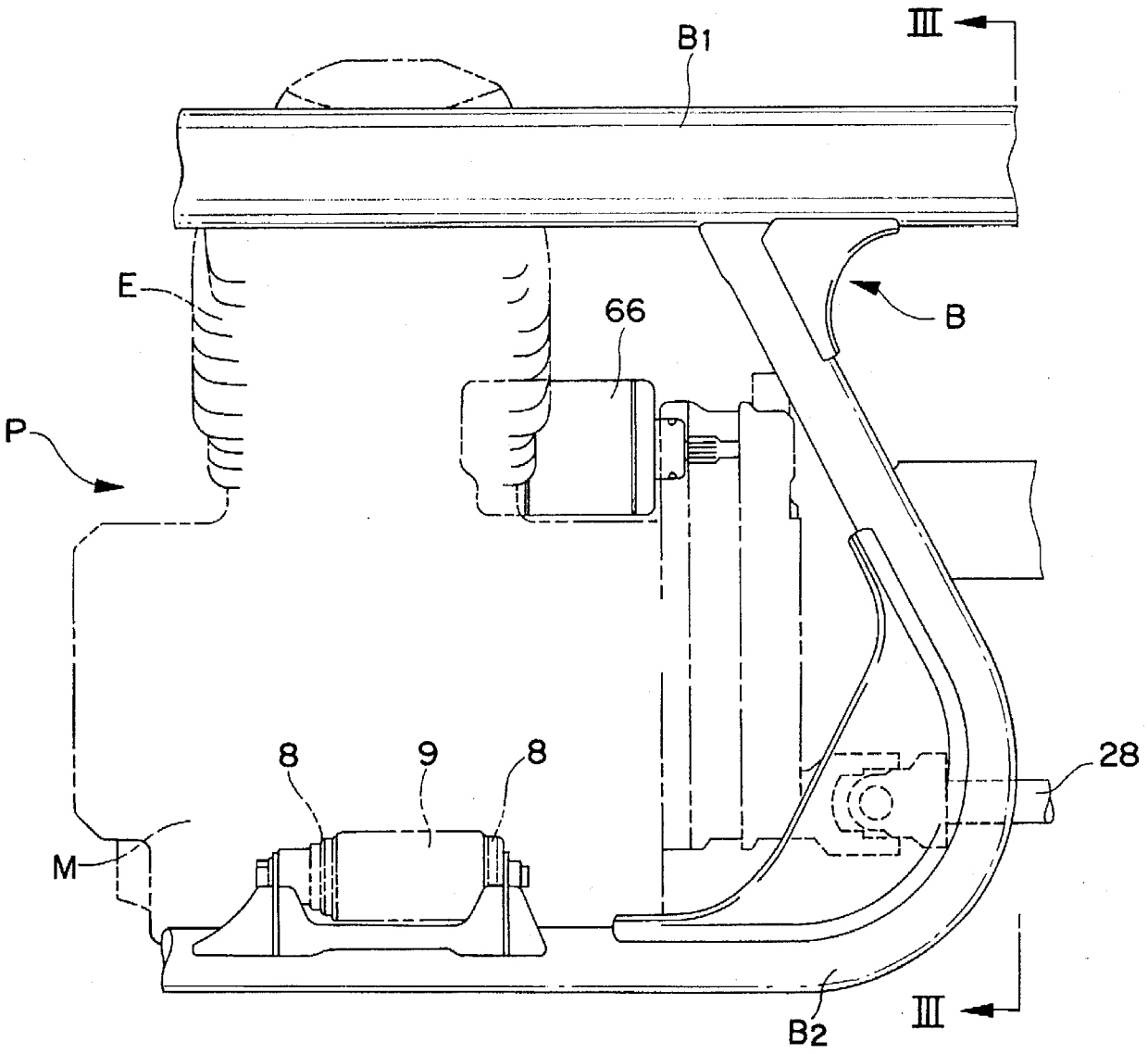
FIG. 2 is an enlarged side view of an essential portion of the vehicle shown in FIG. 1.
Figure 3:
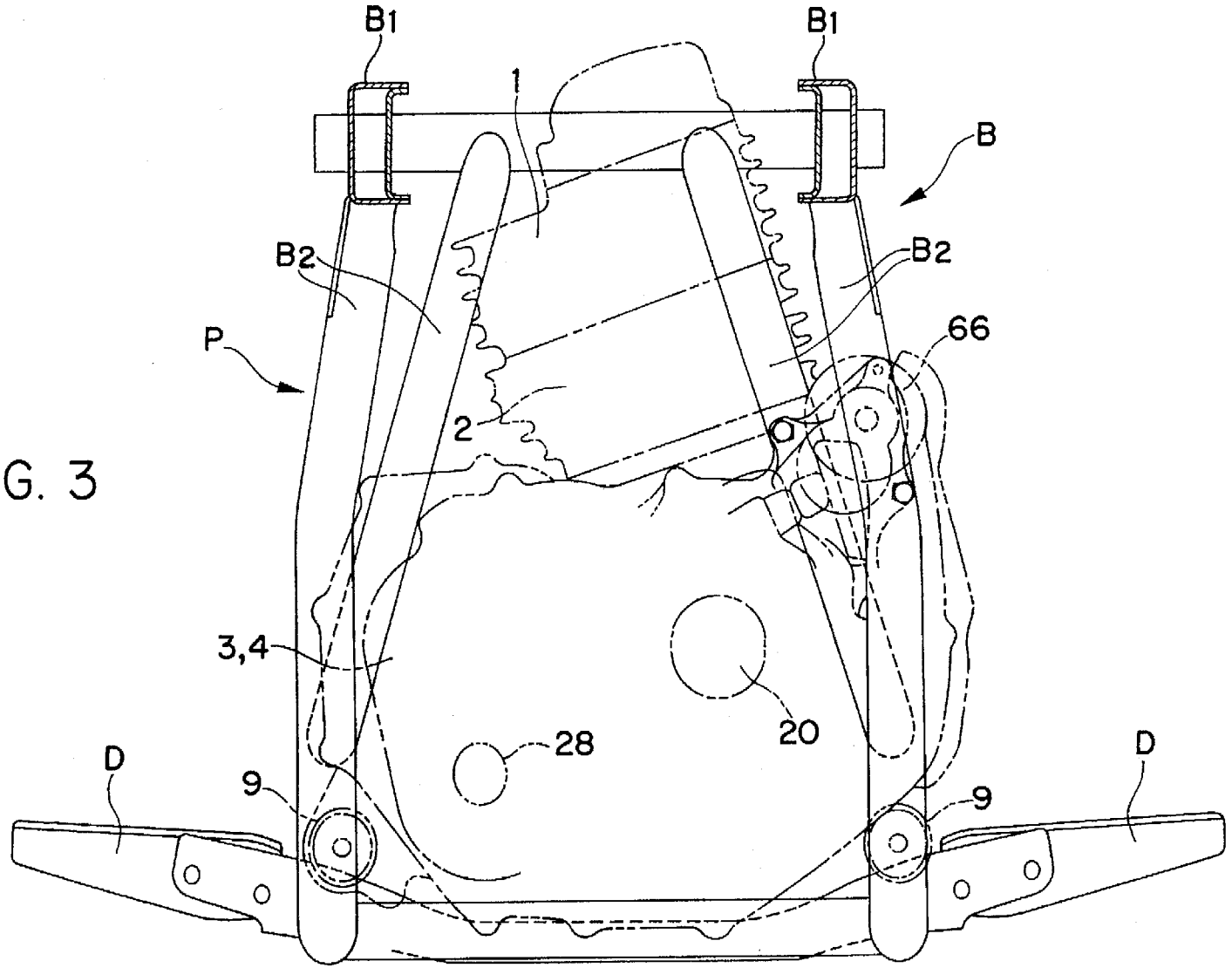
FIG. 3 is a sectional view taken along line III—III of FIG. 2.

The power unit P includes a crank case of an internal combustion engine E and a transmission case of a transmission M, which are integrated with each other. The internal combustion engine E is divided into a cylinder head 1, cylinder block 2, a front crank case 3, a rear crank case 4, a front case cover 5, and a rear case cover 6. As shown in FIGS. 2 and 3, the front crank case 3 and the rear crank case 4 are integrated with each other by means of connecting bolts (not shown) which are connected to the right and left pipe shaped frames $B_2$ through elastic mount members 9 by means of mounting bosses 8 on both the sides of the lower portions of the front and rear crank cases 3, 4.

As shown in FIGS. 6 to 9, the cylinder block 2 is superposed on the front and rear crank cases 3, 4 which are integrally connected to each other. Cylinder-case connecting bolts 11 are screwed in two bolt holes 10 provided in the cylinder block 2 and the front and rear crank cases 3, 4. The cylinder head I and a rocker arm holder 19 are superposed on the cylinder block 2, and a holder-head-cylinder connecting bolt 13 is screwed in a bolt hole 12 provided in the rocker arm holder 19, cylinder head 1 and cylinder block 2. A head-cylinder connecting bolt 15 is screwed in a bolt hole 14 provided in the cylinder head 1 and the cylinder block 2. Head-cylinder-case connecting bolts 17 are screwed into two bolt holes 16 provided in the cylinder head 1, cylinder block 2, front crank case 3 and rear crank case 4. Connecting bolts (not shown) are screwed in bolt holes 18 provided in the rocker arm holder 19, cylinder head 1, cylinder block 2, front crank case 3, and rear crank case 4. The cylinder head 1, cylinder block 2, front crank case 3, rear crank case 4, and rocker arm holder 19 are thus integrally connected to each other.

Figure 5:
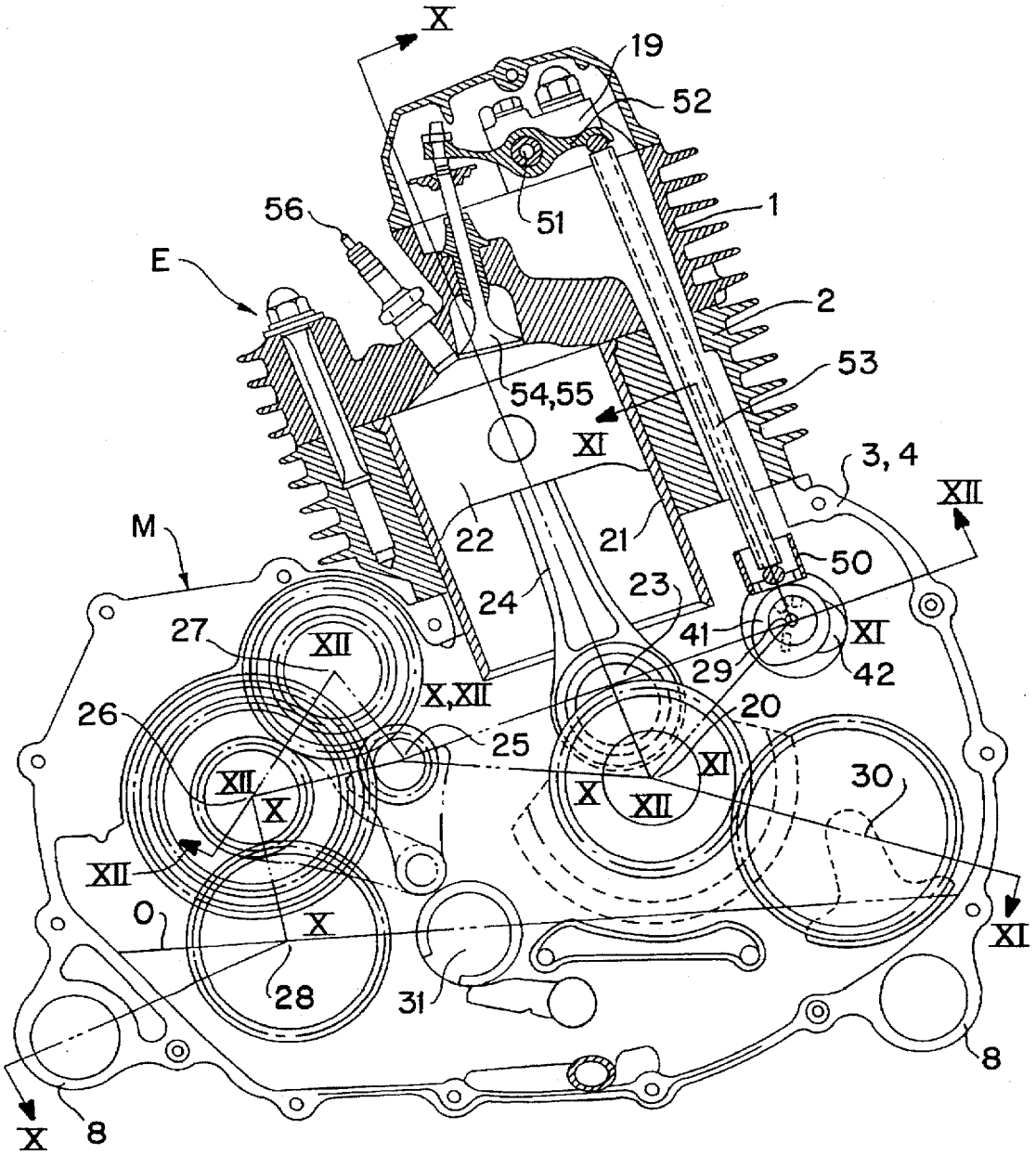
FIG. 5 is a rear view of a cylinder head and cylinder block in the state where a rear case cover is removed, with parts partially broken away.
Figure 6:
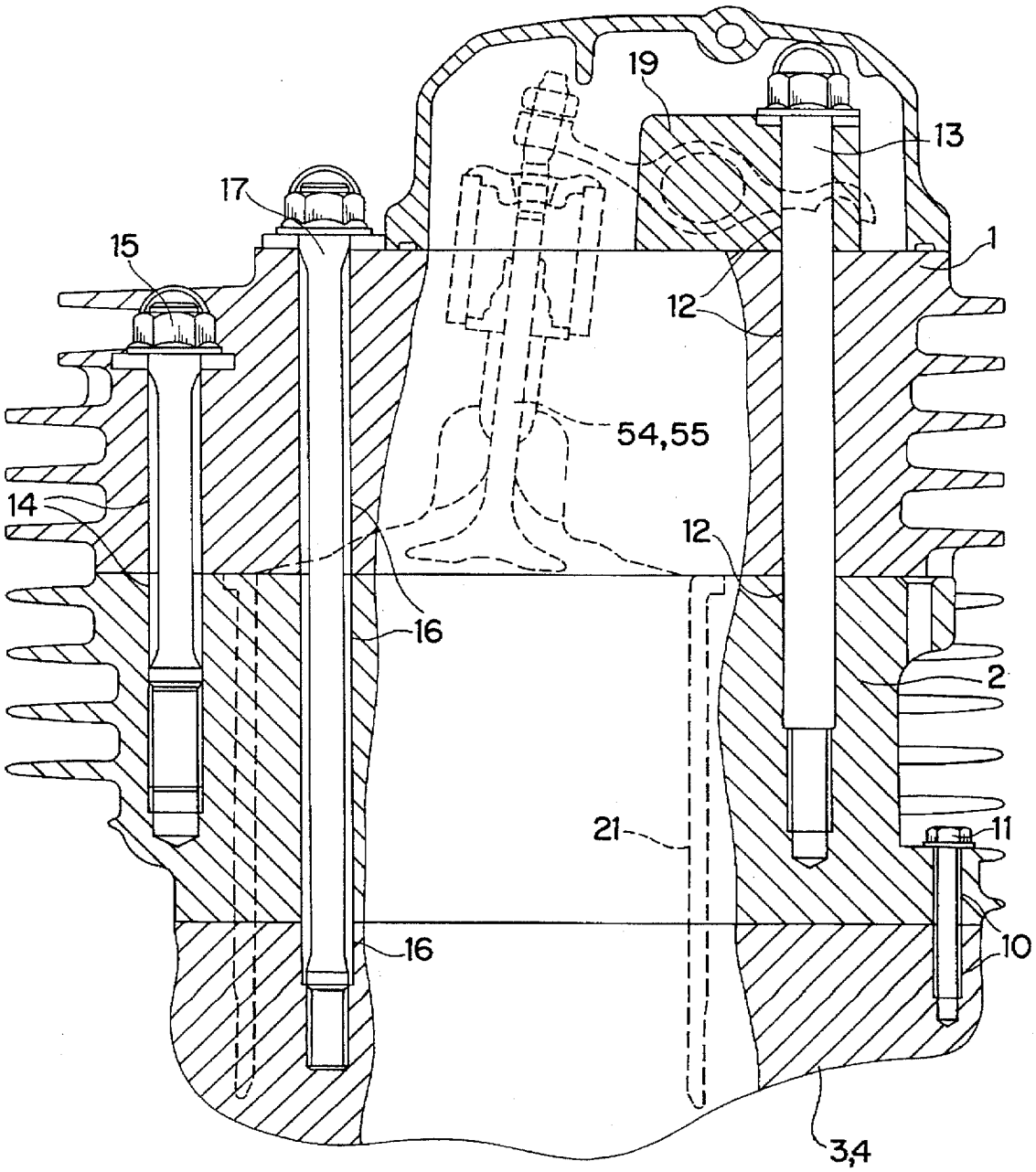
FIG. 6 is a vertical sectional view of an internal combustion engine taken along line VI—VI of FIG. 7.
Figure 7:
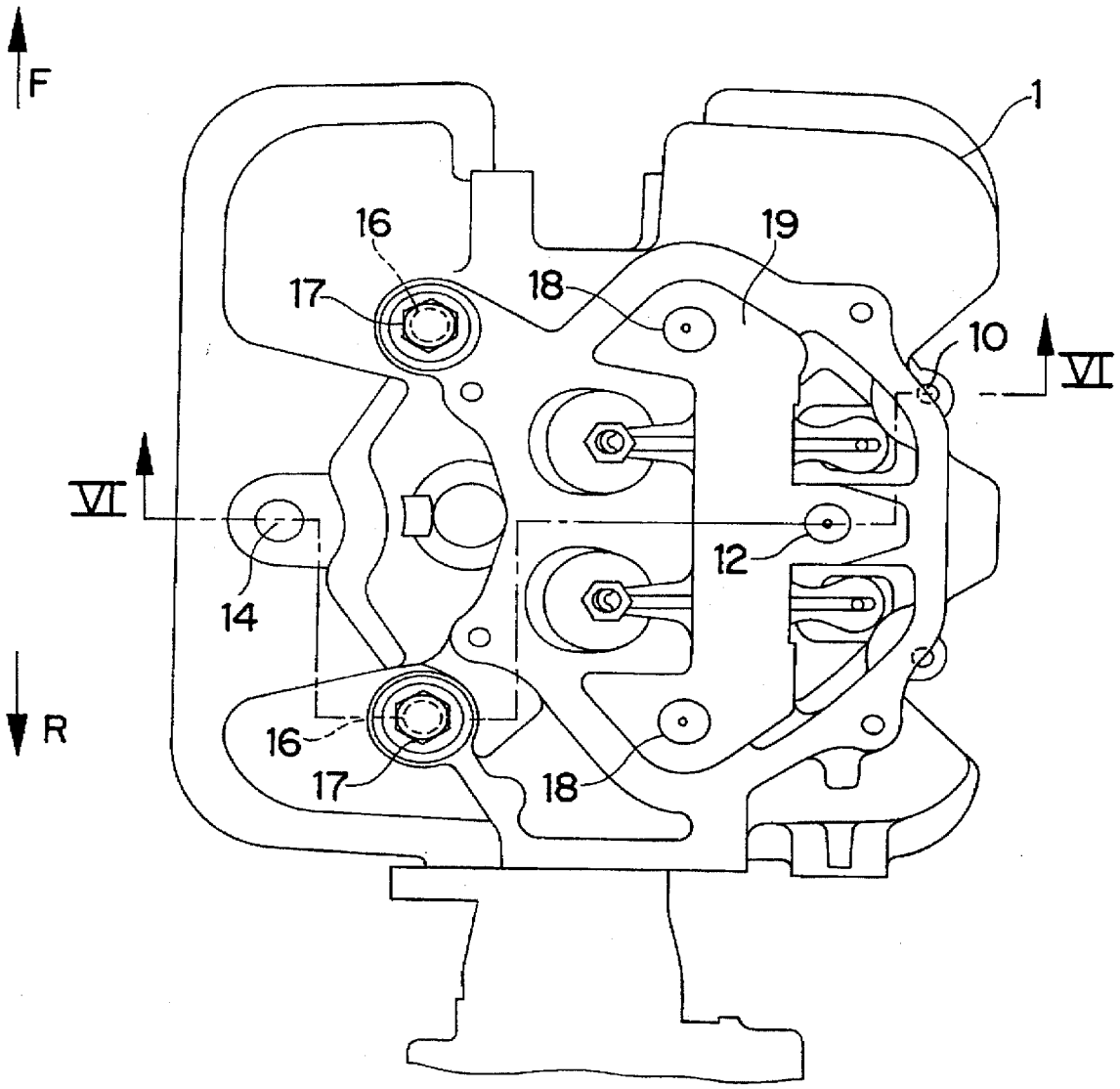
FIG. 7 is a plan view of the cylinder head.
Figure 8:
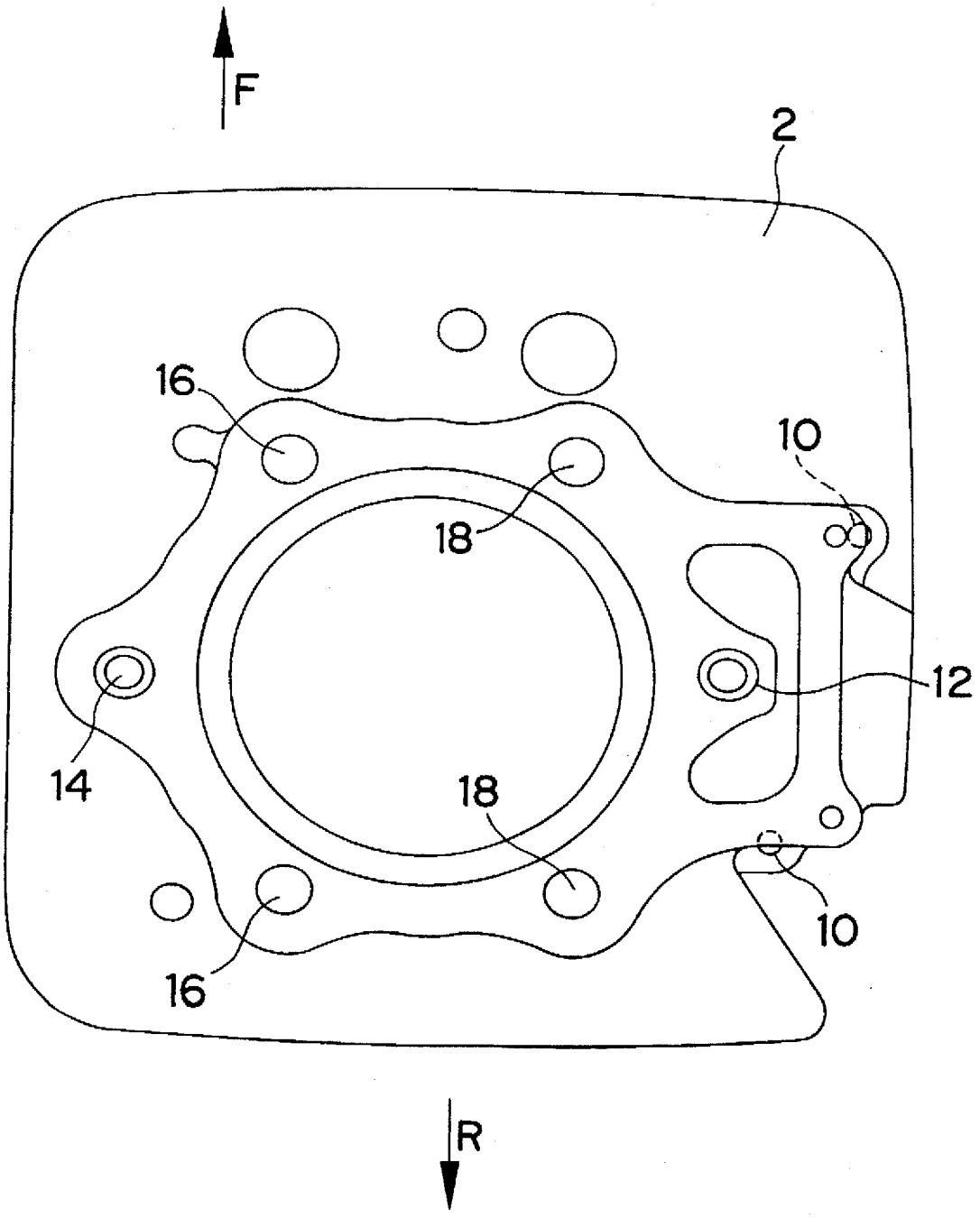
FIG. 8 is a plan view of the cylinder block.
Figure 9:
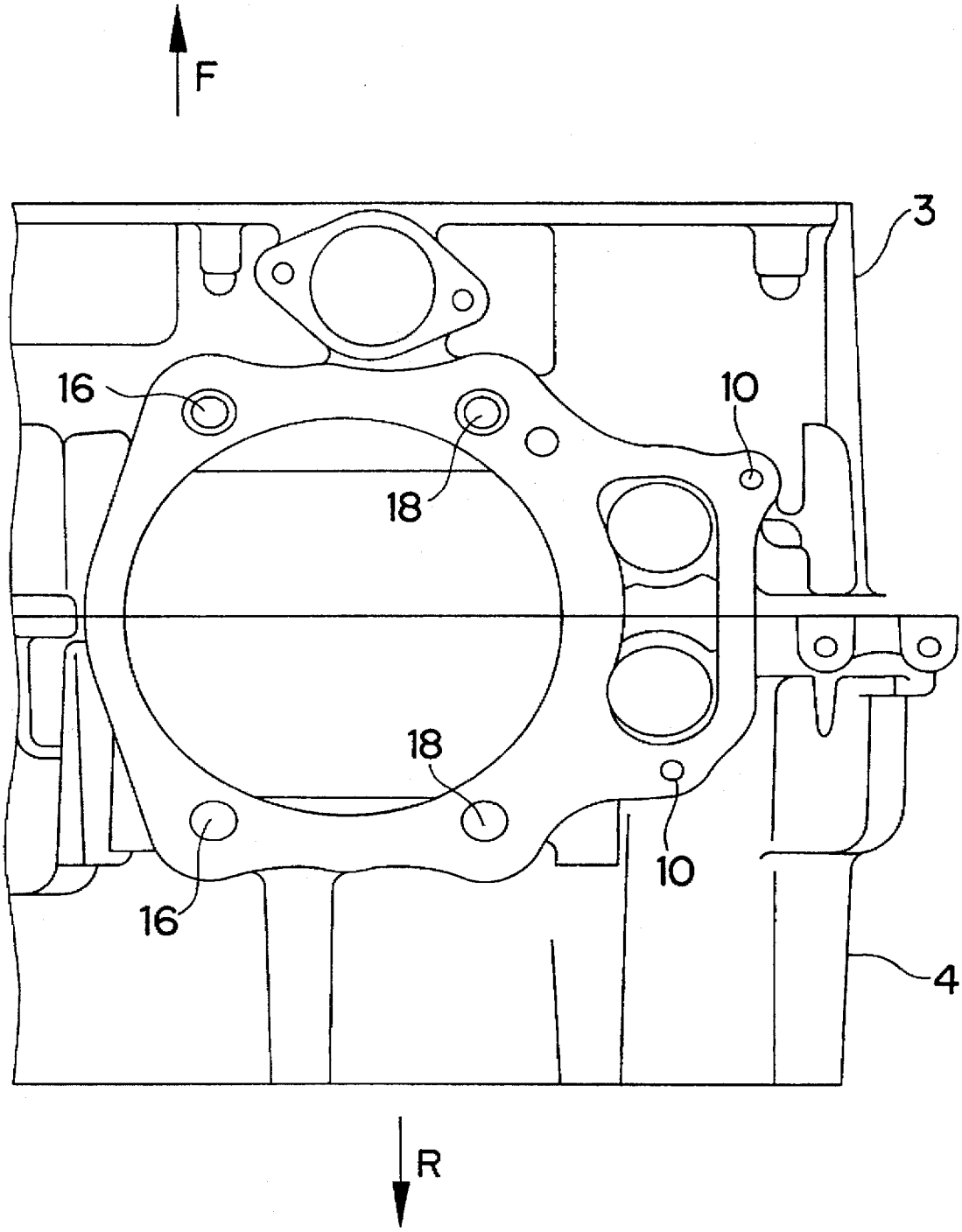
FIG. 9 is a plan view showing essential portions of the front crank case and rear crank case.

A crank shaft 20, extending in the operating direction of the vehicle A, is rotatably supported on the front and rear crank cases 3, 4 of the internal combustion engine E. As shown in FIG. 5, the crank shaft 20 is disposed so as to be slightly shifted rightward from the center of the front and rear crank cases 3, 4. The cylinder block 2 and the cylinder head 1 are tilted obliquely, leftward and upward from the crank shaft 20. A piston 22 slidably mounted in a cylinder 21 is connected to a crank pin 23 of the crank shaft 20 by means of a connecting rod 24. The crank shaft 20 is rotated by the vertical movement of the piston 22.

A main shaft 25 and a countershaft 26 of the transmission M are disposed in this order leftward from the crank shaft 20. A reverse shaft 27 is disposed over the intermediate portion between the main shaft 25 and the countershaft 26, and a drive shaft 28 is disposed under the countershaft 26. In such a state, the main shaft 25, countershaft 26, reverse shaft 27 and drive shaft 28 are rotatable supported by the front and rear crank cases 3, 4 while being disposed in parallel to the crank case 20.

A cam shaft 29 is disposed obliquely, rightward and upward from the crank shaft 20, and a balancer shaft 30 is disposed under the cam shaft 29. A shift drum 31 is disposed under the main shaft 25 and rightward from the drive shaft 28. In such a state, the cam shaft 29, balancer shaft 30 and shift drum 31 are rotatable supported by the front and rear crank cases 3, 4.

Figure 4:
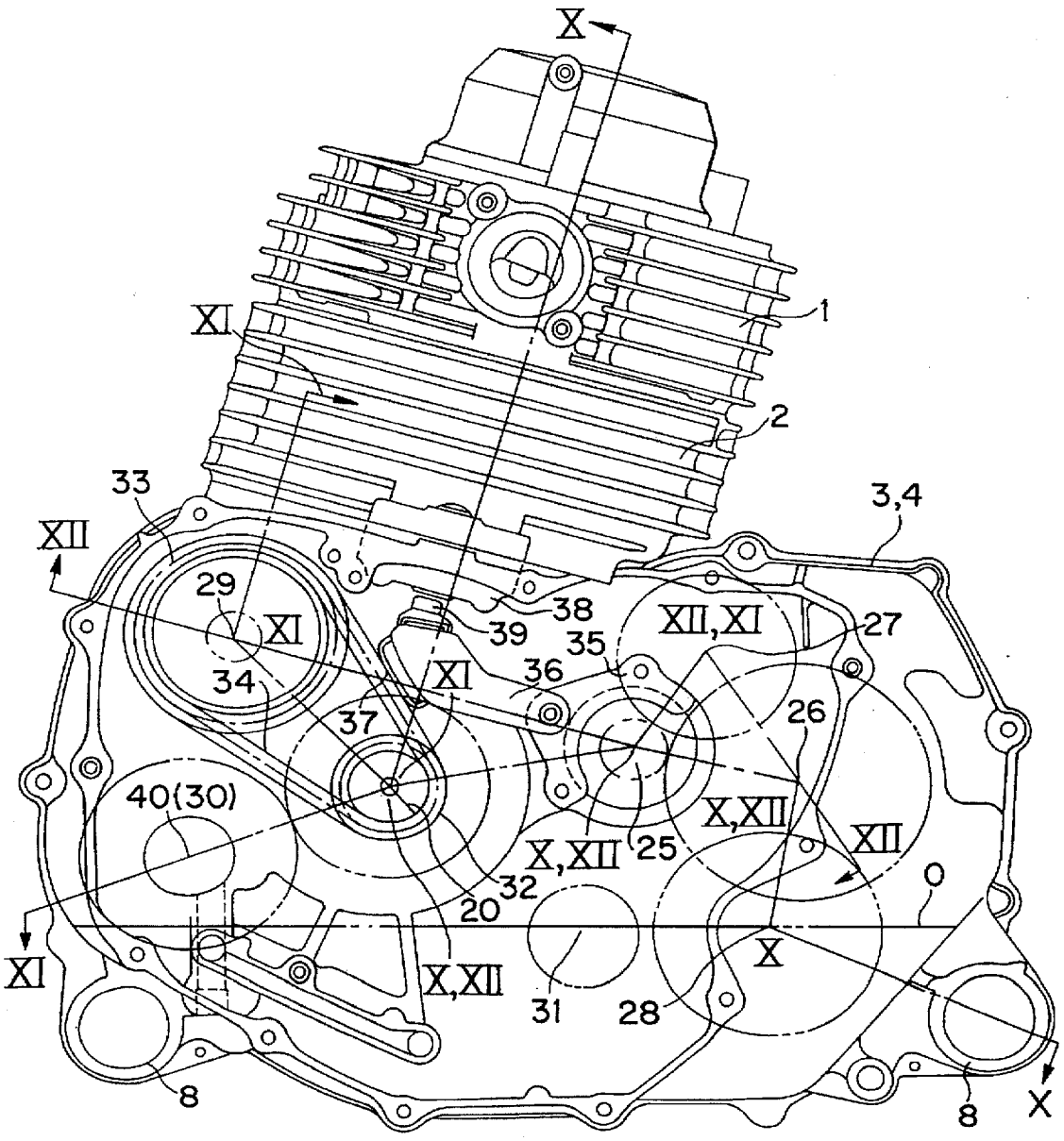
FIG. 4 is a front view of the power unit in which a front case cover is removed.

As shown in FIG. 4, sprockets 32, 33 are respectively provided on the crank case 20 and the cam shaft 29, and an endless chain 34 is hung between the sprockets 32, 33. When the crank shaft 20 is rotated, the cam shaft 29 is rotated at a speed reduction ratio of ½.

Figure 12:
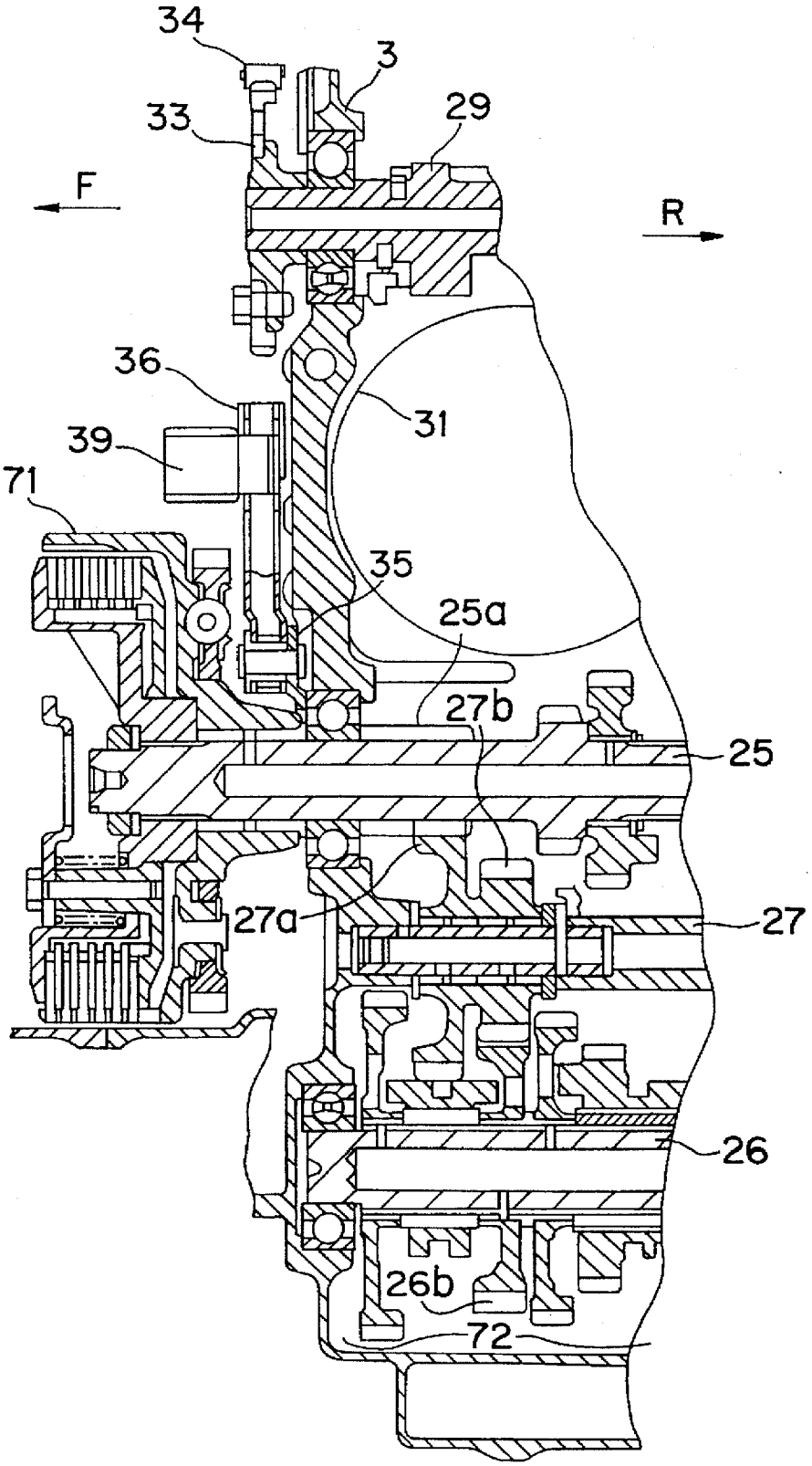
FIG. 12 is a vertical sectional view of the power unit taken along line XII—XII of FIG. 4.

The sprockets 32, 33 are disposed at positions projecting forward from the front crank case 3, and as shown in FIG. 4, the endless chain 34 is suitably stretched. Specifically, a chain tensioner 36 is vertically rockably provided on a bearing holder 35 of the main shaft 25, and a slipper 37 is provided on the lower surface of the leading end of the bearing holder 35. Moreover, as shown in FIG. 12, a pressing portion of an adjusting device fitted from the upper side and mounted on the front crank case 3 by means of a bolt (not shown) is abutted on a receiving portion 39 projecting forward from the chain tensioner 36. The endless chain 34 is thus suitably stretched by means of the chain tensioner 36 biased by the pressing portion of the adjusting device.

Figure 11:
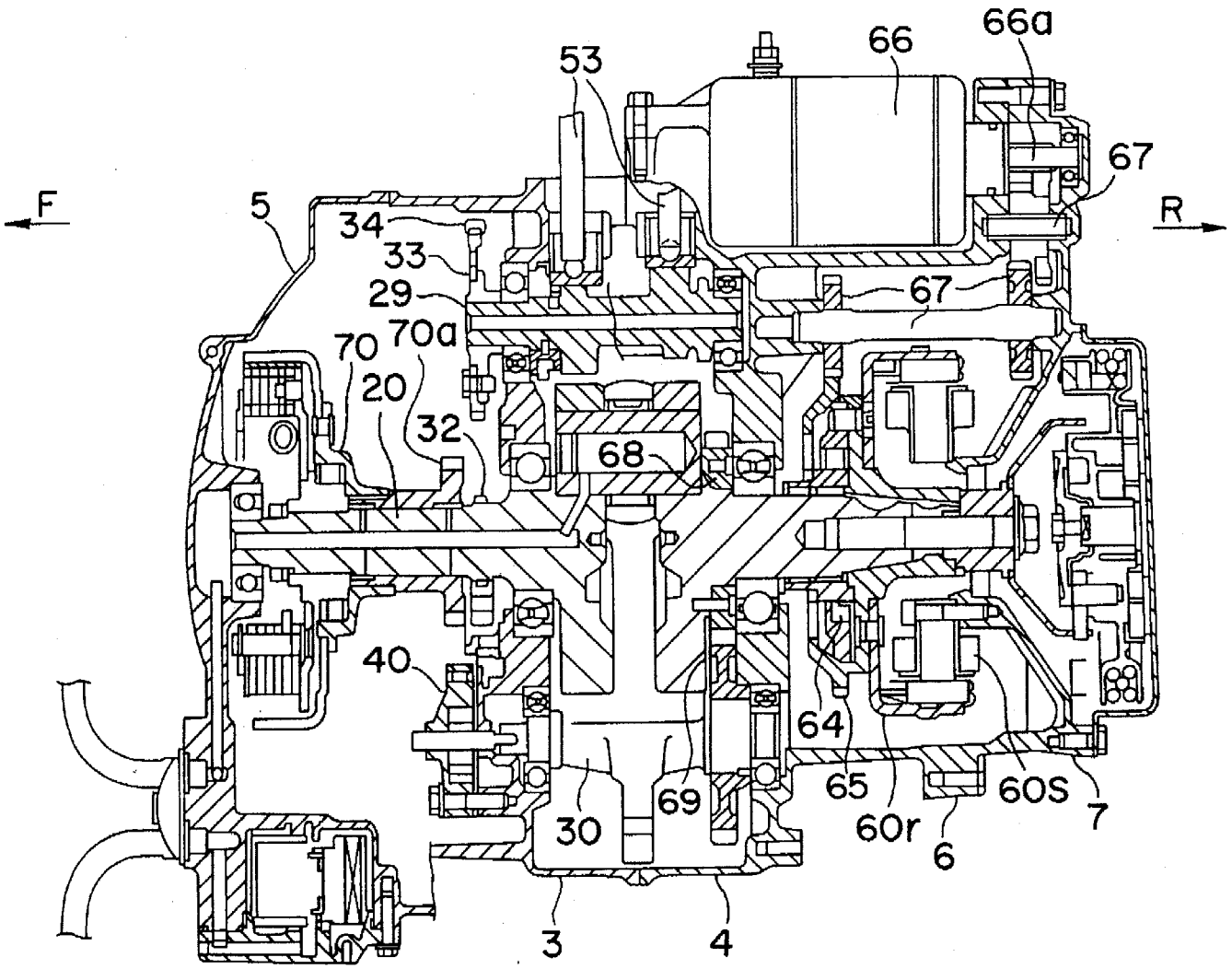
FIG. 11 is a vertical sectional view of the power unit taken along line XI—XI of FIG. 5.

As shown in FIG. 11, a hydraulic pump 40 is disposed in front of the balancer shaft 30, and the rotational shaft of the hydraulic pump 40 is directly connected to the balancer shaft 30. When the internal combustion engine E is operated, the hydraulic pump 40 is rotated together with the balancer shaft 30 for supplying lubricating oil to portions to be lubricated in the internal combustion engine E and the transmission M.

Figure 13:
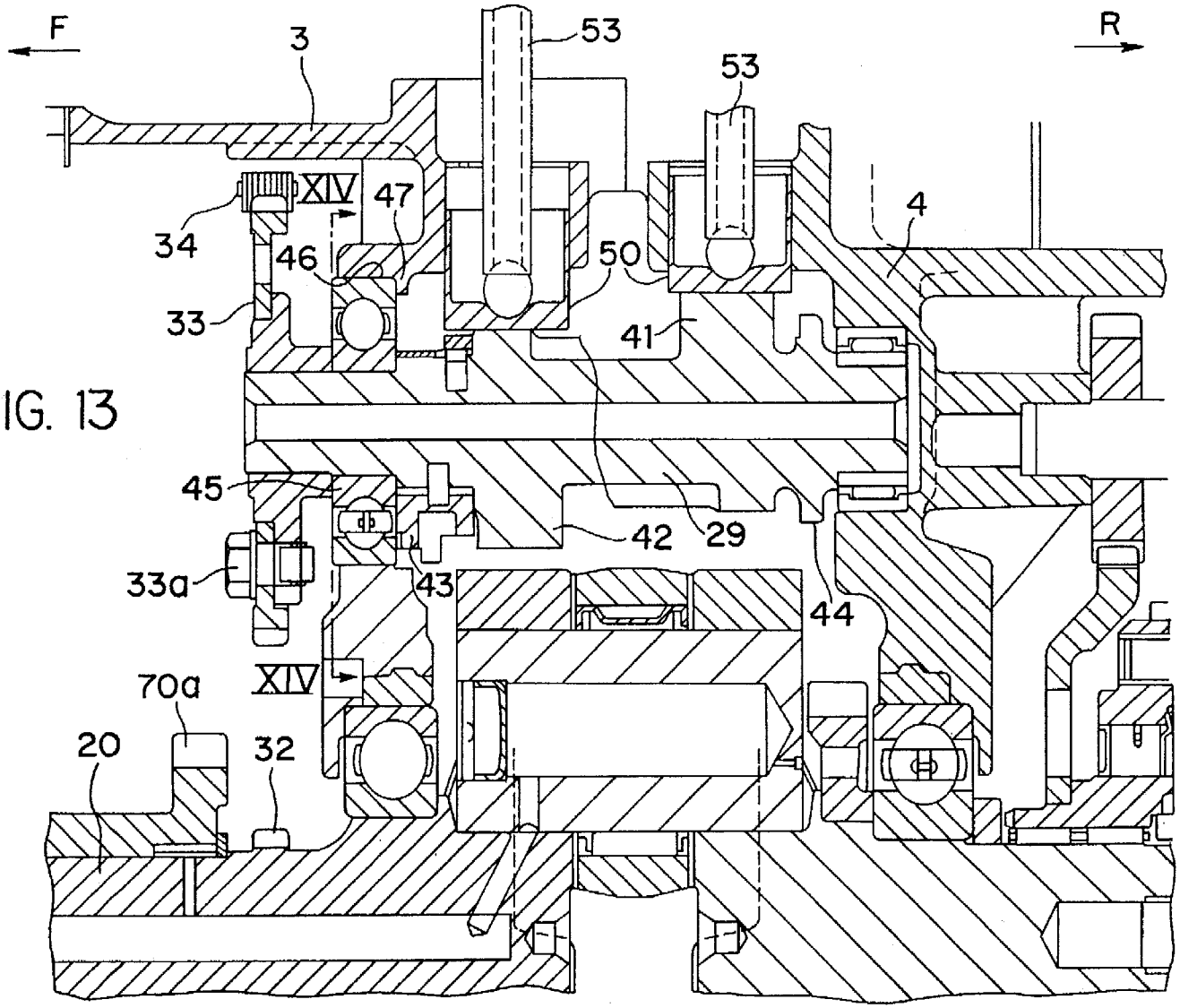
FIG. 13 is an enlarged vertical sectional view showing an essential portion of FIG. 11.
Figure 14:
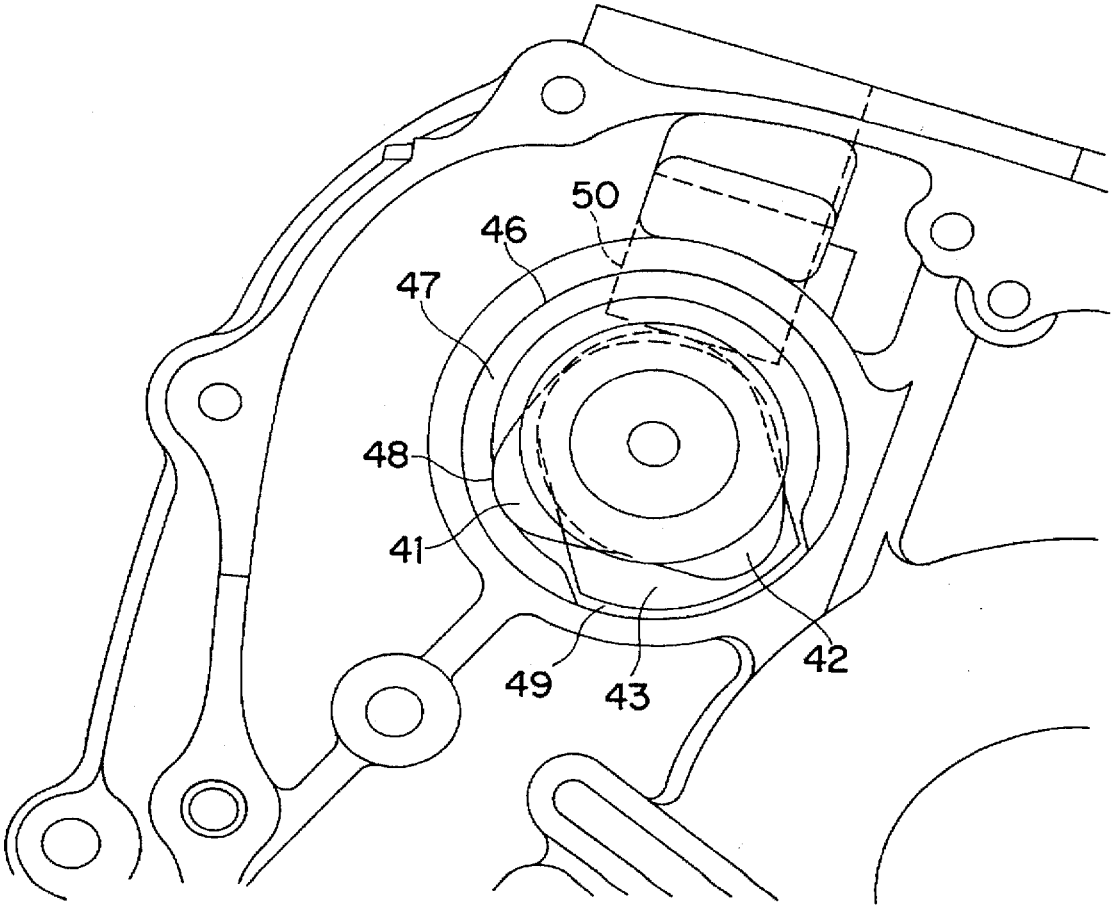
FIG. 14 is a sectional view taken along line XIV—XIV of FIG. 13.

As shown in FIGS. 11 and 13, an intake cam 41 and an exhaust cam 42 are formed integrally with the cam shaft 29, and a decompression cam 43 is additionally provided adjacent to the front side of the exhaust cam 42. A rib 44 is formed in back of the intake cam 41. A cylindrical surface portion 46, having a diameter being the same as that of the outer periphery surface of a ball bearing 45 for supporting the front portion of the cam shaft 29 and being larger than the diameter of the base circle of the cam shaft 29, is formed on the front crank case 3. A locking stepped portion 47 is formed in back of the cylindrical surface portion 46. Cutout portions 48 are formed in the locking stepped portion 47 so that the cam shaft 29 can be pulled forward in the state that the intake cam 41, exhaust cam 42 and the decompression cam 43 are arranged as shown in FIG. 14.

Tappets 50 are vertically movably fitted in the front and rear crank cases 3, 4 at the positions over the intake cam 41 and the exhaust cam 42. As shown in FIG. 5, a push rod 53 is interposed between the right end of a rocker arm 52 rockably supported on the rocker arm holder 19 through a rocker shaft 51 and the tappet 50. The rocker arm 52 is vertically rocked in accordance with the rotation of the cam shaft 29 for opening/closing each of an intake valve 54 and an exhaust valve 55 positioned rightward from the center of the cylinder 21 and abutted on the left end of the rocker shaft 51.

An ignition plug 56 is mounted in such a manner as to be tilted leftward from the center line of the cylinder 21.

A carburetor 59 is connected to an intake passage 57 provided with the intake valve 54, and an exhaust pipe (not shown) is connected to an exhaust passage 58 provided with the exhaust valve 55.

Figure 10:
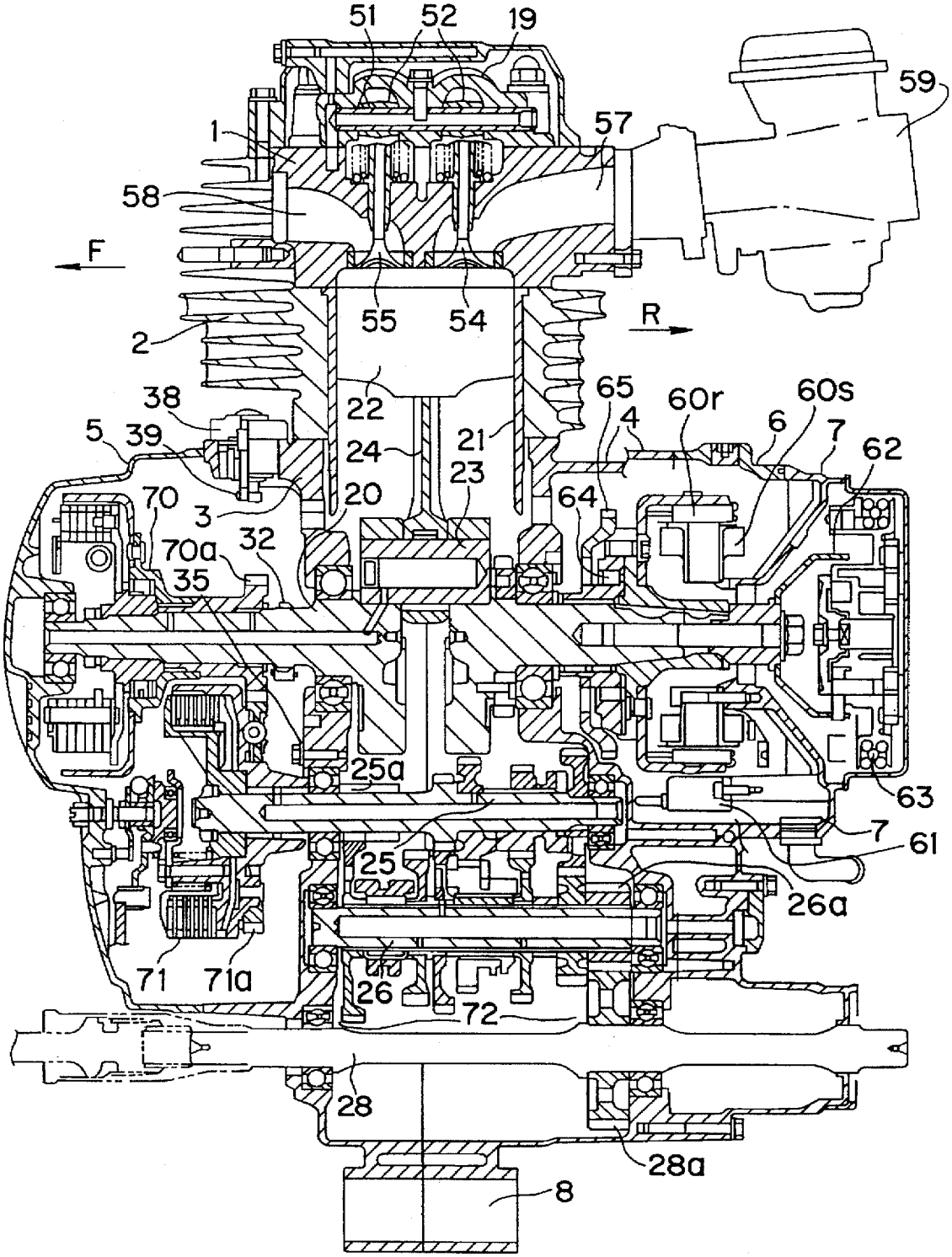
FIG. 10 is a vertical sectional view of the power unit taken along line X—X of FIG. 4.

A rotor **60*r* is mounted on the rear portion of the crank shaft 20, and a cover 7 is removably mounted on the rear case cover 6 mounted on the rear crank case 4. A stator 60*s* is mounted on the cover 7, and as shown in FIG. 10, the members and other electrical equipment are mounted on the cover 7. By removing the cover, the stator 60*s*, a pulser 61 and the other electrical equipment can be removed together with the cover 7**.

A starting wheel 62 is mounted on the rear end of the crank shaft 20, and a recoil starter 63 is provided in such a manner as to face to the starting wheel 62. The internal combustion engine E can be started by manually operating the recoil starter 63.

As shown in FIG. 11, a starting gear 65 is positioned in front of the rotor 60*r* and is freely fitted around the crank shaft 20 through a one-way clutch 64. An output shaft 66*a* of a starter motor 66 mounted on the rear crank case 4 is connected to the starting gear 65 through a reduction gear unit 67. When the starter motor 66 is rotated, the crank shaft 20 is rotated through the reduction gear unit 67 starting gear 65 and one-way clutch 64, thus automatically starting the internal combustion engine E.

A centrifugal type starting clutch 70 is provided on the front end of the crank shaft 20, and a multi-disc type gear shift clutch 71 is provided on the front end of the main shaft 25. An output gear 70*a* of the centrifugal type starting clutch 70 is meshed with an input gear 71*a* of the multi-disc type gear shift clutch 71. In the case where the crank shaft 20 is stopped or rotated at a rotational speed less than a specified value, the centrifugal type starting clutch 70 is in the cut-off state; while in the case where it is rotated at a rotational speed more than the specified value, the centrifugal type starting clutch 70 is connected to the multi-disc type gear shift clutch 71.

As shown in FIG. 10, a multi-stage speed change gear train 72 is interposed between the main shaft 25 and the countershaft 26. The output gear 26*a* of the countershaft 26 is meshed with the input gear 28*a* of the drive shaft 28. As shown in FIG. 12, the output gear 25*a* of the main shaft 25 is meshed with the input gear 27*a* of the reverse shaft 27. The output gear 27*b* of the reverse shaft 27 is meshed with the reverse input gear 26*b* of the countershaft 26. When the change pedal near the left step D is shifted at a specified speed change position or reverse position, the multi-disc gear shift clutch 71 is cut-off only upon this operation, and the multi-stage speed change gear train 72 and the reverse input gear 26*b* of the countershaft 26 are switched, so that the countershaft 26 is rotated at a specified gear shift ratio or normal/reverse state.

In the embodiment shown in FIGS. 1 to 14 having the above-described construction, when a driver sitting astride the seat S puts his feet on the steps D and starts the internal combustion engine E by means of the starter motor 66 or recoil starter 63, and in such a state, he holds a right grip of the steering handle H and operates an operating lever (not shown) provided under the right grip, the carburetor 59 is opened and the internal combustion engine E is accelerated, and when the crank shaft 20 is rotated at a rotational speed over a specified value, the centrifugal type starting clutch 70 is automatically connected, thus operating the off-road running saddle type vehicle A.

Since the crank shaft 20, main shaft 25, countershaft 26, reverse shaft 27 and drive shaft 28 all extend in the operating direction of the vehicle A, it becomes possible to transmit the power of the internal combustion engine E to a front wheel differential gear Gf and a rear wheel drive gear Gr of the front wheels Wf and the rear wheels Wr only using the minimum number of bevel gears, and hence to reduce the weight of the power transmission system.

In the power unit P, the upper portion of the crank shaft 20 is tilted leftward and the lower portion of the crank shaft 20 is shifted slightly rightward from the center of the front and rear crank cases 3, 4. The main shaft 25, countershaft 26, reverse shaft 27, drive shaft 28 and shift drum 31 of the transmission M are disposed leftward from the crank shaft 20. The cam shaft 29, balancer shaft 30, hydraulic pump 40, starter motor 66, tappets 50 of the valve system, rocker shaft 51, rocker arm 52 and push rod 53 are disposed rightward from the crank shaft 20. With this construction, the height of the front and rear crank cases 3, 4 can be lowered while suppressing the lateral width of the front and rear crank cases 3, 4, thus reducing the size of the power unit P. Moreover, the front shape of the power unit P can be made substantially into an isosceles triangle, to lower the center of gravity of the power unit P. In addition, since the power unit P is not positioned near the inside of the thighs of a driver, the driver can sit at ease astride the seat S positioned over the power unit P.

Since the cylinder 21 is tilted leftward and the ignition plug 56 is also tilted leftward from the center of the cylinder 21, the ignition plug 56 can be easily exchanged without obstruction by the fuel tank T and the seat S positioned over the cylinder 21.

The crank shaft 20 is tilted leftward, the cam shaft 29 is disposed rightward and upward from the crank shaft 20, and the push rod 53 is disposed rightward from the cylinder 21. Accordingly, as compared with the case where the push rod is disposed over the crank shaft, the dimension of the internal combustion engine E in the direction of the crank shaft is reduced to thereby shorten the whole longitudinal length of the power unit P, and the length of the push rod 53 is shortened to thereby reduce the weight of the reciprocating portion of the valve system.

Since the balancer shaft 30 is positioned under the cam shaft 29 and the hydraulic pump 40 is disposed along the axial line of the balancer shaft 30, the height of the hydraulic pump 40 relative to a lubricating oil O can be lowered to reduce the suction height of the hydraulic pump 40, thus smoothly performing the suction of the lubricating oil.

Since the cylinder head 1, cylinder block 2, front crank case 3, rear crank case 4 and rocker arm holder 19 are connected to each other as shown in FIGS. 6 to 9, they can be forcibly integrated with each other. Also, the cylinder head 1, cylinder block 2 and the rocker arm holder 19 are connected to each other and can be easily removed from the front and rear crank cases 3, 4 only by loosening the cylinder-case connecting bolts 11, head-cylinder-case connecting bolts 17 and the bolts (not shown) screwed in the bolt holes 18.

In the case where the cam shaft 29 is exchanged by removing the cylinder head 1 and the cylinder block 2 from the front and rear crank cases 3, 4, the sprocket 33 is dismounted from the cam shaft 29 by removing a bolt 33*a* connecting the cam shaft 29 to the sprocket 33 as shown in FIG. 13. In this case, as illustrated in FIG. 14, unless the intake cam 41 is aligned to the cutout portion 48 and the exhaust cam 42 and the decompression cam 43 are aligned to the cutout portion 49 after the tappets 50 are removed upward from the front and rear crank cases 3 and 4, the cam shaft 29 cannot be removed. In addition, as illustrated in FIG. 13, if the rib 44 is locked with the tappet 50 dropped on the base circle of the intake cam 41 or the intake cam 41, the exhaust cam 42 and the decompression cam 43 are locked with the locking stepped portion 47, as illustrated in FIG. 14, and thereby the cam shaft 29 cannot be removed. As a result, it becomes possible to prevent an inconvenience that the front and rear crank cases 3, 4 are disassembled by taking out the tappet 50 erroneously dropped in the front and rear crank cases 3, 4.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A valve system for an internal combustion engine having a cam shaft axially removably supported and push rods mounted for reciprocation on an upper surface of said cam shaft through tappets for opening/closing overhead valves comprising:

a crankcase for mounting said cam shaft for rotation;

an opening formed in said crankcase for removing said cam shaft from said crankcase, said opening being of a predetermined size larger relative to size of a cam base circle and smaller in size relative to a size of a cam lobe vertex;

cutout portions formed in said crankcase being larger in size relative to said cam lobe vertex, said cutout portions being provided on part of said opening;

said cutout portions being disposed at positions facing tappets relative to an axial center of said cam shaft; and a rib projecting from said cam base circle and being disposed on said cam shaft on the opposed side to said opening with said cam lobe being positioned therebetween.

2. The valve system for an internal combustion engine according to claim 1, and further including an intake cam lobe and an exhaust cam lobe formed on said cam shaft, a first cutout portion being formed to accommodate said intake cam lobe and a second cutout portion being formed to accommodate said exhaust cam lobe for permitting removal of said cam shaft from said crank case when said intake cam lobe is aligned with said first cutout portion and said exhaust cam lobe is aligned with said second cutout portion.

3. The valve system for an internal combustion engine according to claim 2, and further including a decompression cam operatively connected to said cam shaft, said second cutout being formed to accommodate said decompression cam when said decompression cam is aligned with said second cutout portion to permit removal of said cam shaft from said crank case.

4. The valve system for an internal combustion engine according to claim 1, wherein said cam lobe is permitted to be aligned with said cutout portions after said tappets are removed from said crank case.

5. The valve system for an internal combustion engine according to claim 1, and further including a locking step portion being formed on said crank case for preventing removal of said cam shaft when said cam lobe is not aligned with said cutout portions.

6. The valve system for an internal combustion engine according to claim 5, wherein said cutout portions are formed in said locking step portion.

7. The valve system for an internal combustion engine according to claim 1, wherein said tappets prevent removal of said cam shaft when said cam lobe is not aligned with said cutout portions.

8. A valve system for an internal combustion engine having a cam shaft axially removably supported and push rods mounted for reciprocation on an upper surface of said cam shaft through tappets for opening/closing overhead valves comprising:

a crankcase for mounting said cam shaft for rotation;

an opening formed in said crankcase for removing said cam shaft from said crankcase, said opening being of a predetermined size larger relative to size of a cam base circle and smaller in size relative to a size of a cam lobe vertex; and cutout portions formed in said crankcase being larger in size relative to said cam lobe vertex, said cutout portions being formed to permit said cam shaft to be removed from said crankcase when said cam lobe vertex is aligned with said cutout portions.

9. The valve system for an internal combustion engine according to claim 8, and further including a rib projecting from said cam base circle and being disposed on said cam shaft on the opposed side to said opening with said cam lobe being positioned therebetween.

10. The valve system for an internal combustion engine according to claim 8, and further including an intake cam lobe and an exhaust cam lobe formed on said cam shaft, a first cutout portion being formed to accommodate said intake cam lobe and a second cutout portion being formed to accommodate said exhaust cam lobe for permitting removal of said cam shaft from said crank case when said intake cam lobe is aligned with said first cutout portion and said exhaust cam lobe is aligned with said second cutout portion.

11. The valve system for an internal combustion engine according to claim 10, and further including a decompression cam operatively connected to said cam shaft, said second cutout being formed to accommodate said decompression cam when said decompression cam is aligned with said second cutout portion to permit removal of said cam shaft from said crank case.

12. The valve system for an internal combustion engine according to claim 8, wherein said cam lobe is permitted to be aligned with said cutout portions after said tappets are removed from said crank case.

13. The valve system for an internal combustion engine according to claim 8, and further including a locking step portion being formed on said crank case for preventing removal of said cam shaft when said cam lobe is not aligned with said cutout portions.

14. The valve system for an internal combustion engine according to claim 13, wherein said cutout portions are formed in said locking step portion.

15. The valve system for an internal combustion engine according to claim 8, wherein said tappets prevent removal of said cam shaft when said cam lobe is not aligned with said cutout portions.

* * * * *